US008100629B2

(12) United States Patent
Lebret

(10) Patent No.: US 8,100,629 B2
(45) Date of Patent: Jan. 24, 2012

(54) TURBOMACHINE CASING WITH TREATMENT, A COMPRESSOR, AND A TURBOMACHINE INCLUDING SUCH A CASING

(75) Inventor: Yann Pascal Raymond Rene Lebret, Maincy (FR)

(73) Assignee: SNECMA, Paris (FR)

( * ) Notice: Subject to any disclaimer, the term of this patent is extended or adjusted under 35 U.S.C. 154(b) by 941 days.

(21) Appl. No.: 12/035,021

(22) Filed: Feb. 21, 2008

(65) Prior Publication Data

US 2008/0199306 A1 Aug. 21, 2008

(30) Foreign Application Priority Data

Feb. 21, 2007 (FR) ..... 07 53399

(51) Int. Cl.
*F01D 25/24* (2006.01)

(52) U.S. Cl. ..... 415/58.6; 415/58.7

(58) Field of Classification Search ..... 415/58.6, 415/58.2, 58.7, 58.3, 93 R; 416/93 R
See application file for complete search history.

(56) References Cited

U.S. PATENT DOCUMENTS 3,365,172 A * 1/1968 Howald et al. ..... 415/117
3,597,102 A * 8/1971 Unsworth et al. ..... 415/112
3,846,038 A * 11/1974 Carriere et al. ..... 415/1
4,540,335 A * 9/1985 Yamaguchi et al. ..... 415/129
5,586,859 A * 12/1996 Nolcheff ..... 415/58.5
5,762,470 A 6/1998 Gelmedov et al.
6,231,301 B1 * 5/2001 Barnett et al. ..... 415/57.4
6,290,458 B1 * 9/2001 Irie et al. ..... 415/119
6,619,909 B2 * 9/2003 Barnett et al. ..... 415/57.4

FOREIGN PATENT DOCUMENTS

EP 1 052 376 A2 11/2000
EP 1 069 315 A2 1/2001
EP 1 103 725 A2 5/2001
EP 1 413 771 A1 4/2004
EP 1 659 293 A2 5/2006

* cited by examiner

*Primary Examiner* — Edward Look
*Assistant Examiner* — Adam W Brown
(74) *Attorney, Agent, or Firm* — Oblon, Spivak, McClelland, Maier & Neustadt, L.L.P.

(57) ABSTRACT

A casing supporting a series of stationary vanes between which there are disposed series of moving blades movable in rotation about a longitudinal axis in which the radially outer ends of the moving blades being close to the inside face of the casing is disclosed. The casing includes, at least over an annulus situated facing one of the series of moving blades, at least one casing treatment zone facing towards the blades and including a surface relief disturbance in the form of a groove of closed outline. The invention is applicable to controlling rotating separation in a turbomachine compressor.

16 Claims, 3 Drawing Sheets

TURBOMACHINE CASING WITH TREATMENT, A COMPRESSOR, AND A TURBOMACHINE INCLUDING SUCH A CASING

The invention relates to a casing supporting series of stationary vanes between which there are disposed series of moving blades that are movable in rotation about a longitudinal axis, the radially outer ends of said moving blades being close to the inside face of the casing; the invention relates in particular to a casing for use in an aviation turbojet.

BACKGROUND OF THE INVENTION

The present invention also relates to making a compressor, in particular of the axial type, more particularly a compressor operating at low pressure, but also a compressor operating at high pressure, and including a casing as mentioned above.

The present invention also relates to a turbomachine, in particular a turbojet, including such a casing or such a compressor.

Compressors of this type, as used in particular in turbojets, are constituted by a rotor comprising either a succession of separate disks stacked one after another, or else a single drum for receiving the series of blades of the various stages.

Conventionally, the rotor includes slots made by machining so as to form a gap between two adjacent stages, which gap receives the vanes of stator stages that are secured to a stationary portion presenting a casing.

The casing forms a segment of the radially outermost zone of the flow section in which air passes through the turbomachine.

It is usual for the moving blades to be secured individually to the drum via housings that are distributed regularly and that are present in number equal to the number of blades, each housing being of a shape that is designed to co-operate with a blade root of complementary shape, thereby ensuring that each blade is held radially, e.g. by a fastening of the dovetail type. Usually, the blade roots are held against moving in translation, in particular axial translation relative to their respective housings, by separate means for each blade, e.g. by a system making use of a ball, a pin, a staple, a plate, a spacer, etc.

While a turbojet (especially a modern civil aeroengine) is in operation, and given the temperatures and pressures reached by the hot air, it is necessary to provide a regulation function in the event of pumping.

It should be recalled that pumping is a phenomenon that it is desirable to avoid within an engine since it gives rise to sudden oscillations in air pressure and air flow rate, thereby subjecting the blades to high levels of mechanical stress that can weaken them or even break them. This phenomenon can be initiated by pressure oscillations at the outer end of the blade, with interaction between the boundary layer at the tip of the blade and the boundary layer at the casing being strong.

Likewise, rotating separation is a phenomenon that occurs when certain throttling (operating point) and speed of rotation conditions are combined. In particular, this phenomenon is triggered when the profile is put into a so-called "positive" incidence, giving rise to a non-steady phenomenon that leads to separation occurring locally at one blade, which separation then propagates from one blade to another during a revolution.

This phenomenon is particularly damaging:

Blades become polluted by generalized separation which will lead to pumping; and there is a risk of aeroelastic excitation of the blades involved.

At present, this function of regulating pumping is performed by various types of solution, including discharge valves that enable the boundary layer to be sucked out, or casing treatments that cover the entire annular surface of the annulus facing the moving blade wheel(s) to be treated.

This casing treatment solution has given rise to numerous different embodiments. In particular, in document EP 0 688 400 proposals are made for an annular cavity communicating with the flow path via slots defined by an annular grid of sloping ribs. In document U.S. Pat. No. 6,514,039, the technique is similar and in addition, material treatment, such as laser shock peening, is performed on the bar forming the intermediate part for forming the grid, said treatment serving to make it better at withstanding failure by fatigue.

OBJECTS AND SUMMARY OF THE INVENTION

An object of the present invention is to provide a casing that enables the drawback of prior art casing treatments to be obviated, while avoiding an excessive loss of power.

The present invention thus seeks to enable the pumping phenomenon to be reduced locally by increasing the present pumping margin, but without reducing engine efficiency.

To this end, according to the present invention, the casing includes, in at least one annulus facing one of the series of moving blades, at least one casing treatment zone facing the blades and including at least one groove (recess or furrow) defining a closed outline.

The casing has different types of zones: so-called "smooth" zones (i.e. without specific casing treatment), and zones that are subjected to casing treatment. The number of these zones subjected to casing treatment and the angular coverage occupied by said zones depends on the machine in question, and in some cases could be reduced to a zone occupying 360°. Each of these zones may advantageously be located over an angular sector corresponding to 1.5 to 2.5 times the pitch of the moving blades.

In this way, it can be understood that because of the presence of one or more casing treatment zones, each localized over an angular sector restricted to 1.5 to 2.5 blade pitches, it is possible to evacuate air locally from the boundary layer in the gap situated between the blade and the casing in register with the treatment zone so as to avoid the pumping phenomenon.

This solution makes it possible to build a geometrical structure that contributes to breaking up any tendency of separation to become organized, thereby causing separation to disappear.

Overall, because of the arrangement of the present invention, it is possible to suck away the boundary layer locally where it might generate the pumping phenomenon, without degrading the efficiency of the engine because the above-mentioned air is recirculated, thereby making it possible to improve the stability of the system by minimizing its impact on the operation of the engine.

In an advantageous disposition, said treatment zone extends axially over a distance representing ⅔ to 9/10 of the length of the moving blades in the axial direction.

The ratio between open area in the treatment zone and solid area in the treatment zone is of the order of 2.

Provision can be made for said casing treatment zone to be formed directly in the inside wall of the casing.

Alternatively, said casing treatment zone is formed in a plate that is fitted to the casing. Under such circumstances, provision can be made for said plate to be made out of an abradable material, either completely or at its surface.

In a second embodiment, the casing further includes a cavity formed radially outside the treatment zone. This cavity presents an axial extent (in the length direction of the cavity) and/or a transverse extent (in the width direction of the blade) matching the treatment zone, or else an extent that is smaller in one and/or both directions, or else an extent that is greater in one and/or both directions.

Under such circumstances, provision can be made for the casing to present a plurality of treatment zones in a given annular portion, and for said cavity of each treatment zone to be in communication with said cavity of another treatment zone. This encourages air to flow between the treatment zones.

It is also possible to implement one or the other of the following dispositions:

- the depth of said cavity lies in the range 1 to 3 times the depth of the treatment zone; and
- the extent of said cavity in the axial direction lies in the range 10% to 20% greater than the extent of the treatment zone in the axial direction.

BRIEF DESCRIPTION OF THE DRAWINGS

Other advantages and characteristics of the invention appear on reading the following description made by way of example and with reference to the accompanying drawings, in which.

DETAILED DESCRIPTION OF THE INVENTION

Figure 1:
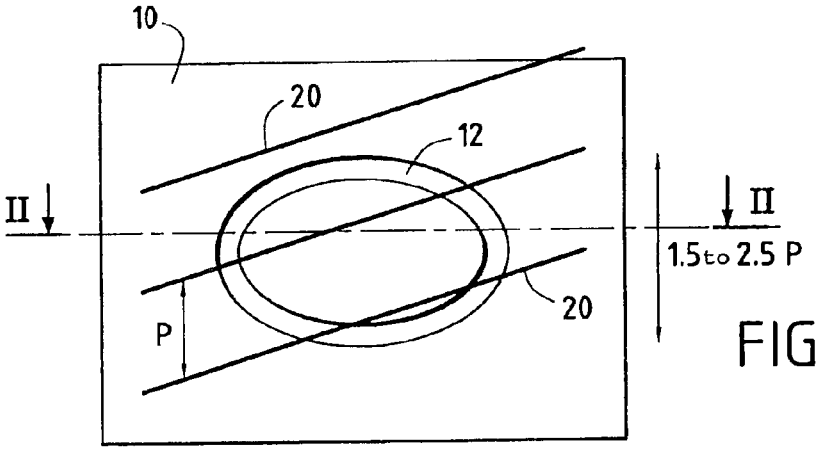
FIG. 1 is a fragmentary diagrammatic view in projection showing the inside face that faces towards the moving blade tips in a casing constituting a first variant of a first embodiment of the invention.

With reference to FIG. 1, there can be seen a portion of a casing 10 occupying an angular sector of circumferential extent that corresponds to the height direction of the drawing sheet, and of axial extent that corresponds to the width direction of the sheet. More precisely, FIG. 1 shows this portion of the casing 10, looking at its radially inner face that faces towards a wheel of moving blades (not shown in FIG. 1).

However, in FIG. 1, the positions of three blades 20 are represented by three oblique lines, the spacing P between two of these lines corresponding to what is referred to below as one blade pitch.

As can be seen in FIG. 1, the inside surface of the casing portion shown includes a groove 12 of closed outline and of oval shape, said groove being for example machined directly in the casing.

According to an essential characteristic of the present invention, it can be understood that the groove 12 forms a local treatment zone of the casing, which treatment does not extend over the entire annular periphery of the casing 10.

More precisely, provision is made for said groove 12 to constitute a casing treatment zone that occupies an angular sector that is limited to 1.5 to 2.5 blade pitches P.

This angularly limited shape for the casing treatment corresponds to a topology that is entirely different from that usually encountered for this type of casing treatment.

Figure 2:
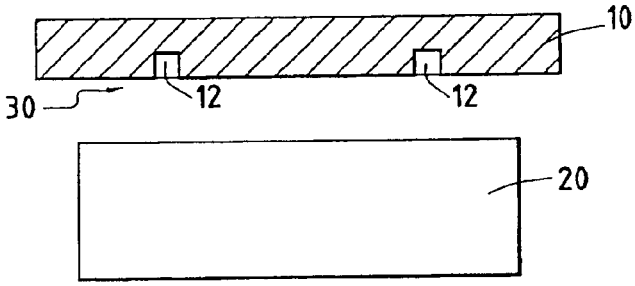
FIG. 2 is a fragmentary diagrammatic view in side section of the FIG. 1 casing seen looking along direction II-II, together with an end portion of a blade.

With reference to FIG. 2, it can be seen more precisely that facing a longitudinal section of the blade 20, the gap 30 between the blade 20 and the casing treatment zone that includes the groove 12 presents a radial enlargement in two locations corresponding to the hollows formed by the groove 12. This configuration serves to impart local disturbances of the rotating separation phenomenon mentioned in the introduction.

It will be understood that the casing 10 may present around its entire periphery a plurality of similar grooves 12 (e.g. two, three, or more) that are spaced apart regularly.

As an indication, the groove 12 may present a width lying in the range 5% to 25% of the pitch, so as to define an oval shape that extends axially (major dimension of the oval shape) over a distance lying in the range 60% to 90% of the length of the channel formed between blades, and transversely (minor dimension of the oval shape) over a distance lying in the range 10% to 90% of the width of the channel formed between blades.

It will be understood that obtaining such a groove 12 of closed outline and oval shape can be achieved easily merely by machining the radially inside surface of the casing 10.

Figure 9:
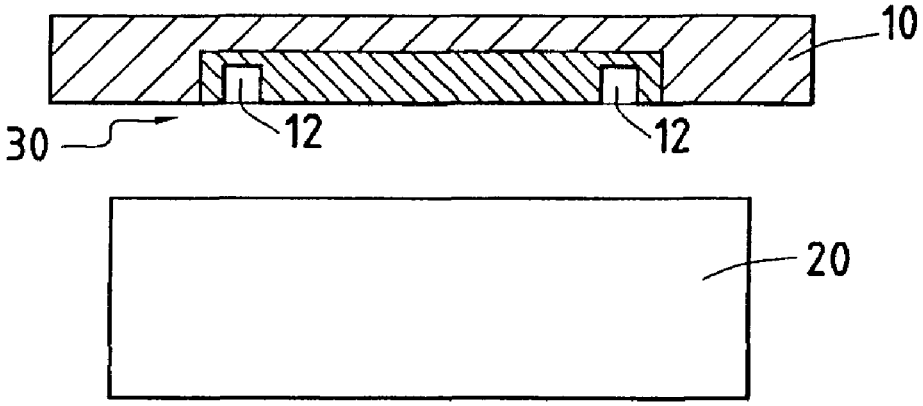
FIG. 9 is a view similar to FIG. 2 showing a third variant of the first embodiment of the invention

Alternatively, as shown in FIG. 9, this groove 12 of closed outline and oval shape may be formed in a plate that is fitted to the casing 10, which plate may be made of an abradable material.

In general, the shape of the groove (or recess), its depth, and the area it covers are the result of optimization depending on the way in which the blade does its work. The purpose of treating the casing in this manner that is localized over a few centimeters to a few tens of centimeters is to modify the energy distribution of the boundary layer, to give back energy to the boundary layer of the zone at risk of the blade that is subject to separation, and also to act as a disturber that prevents separation becoming established and propagating to the adjacent blades.

It should be observed that the groove(s) may begin before the leading edge and terminate after the trailing edge, and that it may be necessary to use treatments with concentric grooves, or to have a set of mirror-image grooves by performing two adjacent treatments with a plane of symmetry between them.

Figure 3:
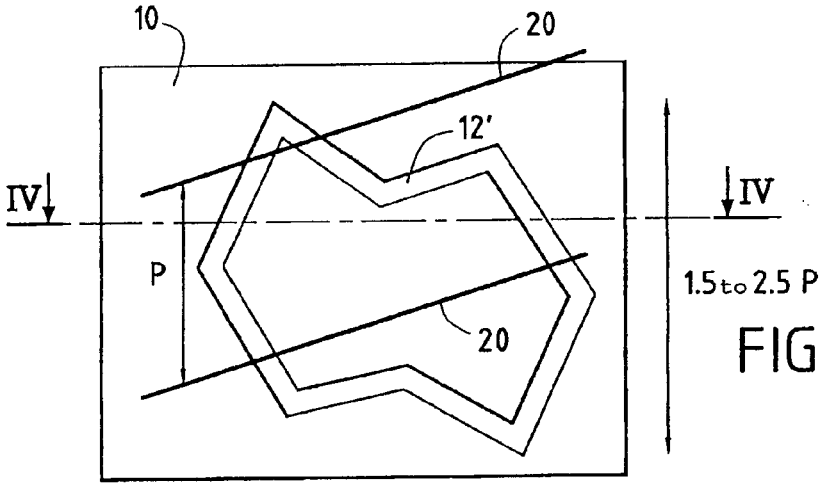
FIGS. 3 and 4 are views similar to FIGS. 1 and 2 showing a second variant of the first embodiment of the invention.

With reference to FIG. 3, there can be seen elements as described above with reference to FIGS. 1 and 2, in association with identical reference signs. In a second variant of the first embodiment shown in FIGS. 1 and 2, the groove 12' continues to present a closed outline, but it is no longer oval, and instead corresponds to a set of rectilinear segments interconnected to form an irregular geometrical figure, in this example with eight sides.

It will readily be understood that instead of using this irregular octagon, it is possible to use other geometrical shapes presenting a number of sides that is fewer or more than eight, or indeed to form a closed outline that is generally curved, but different from an oval shape, or indeed any other ovoid or egg-shape.

In the figures, the grooves are defined over a portion of interblade pitch, but this pitch portion could be extended to an angle of 360°.

Reference is made below to FIGS. 5 to 8 which show variants of the casing in the second embodiment.

Figure 5:
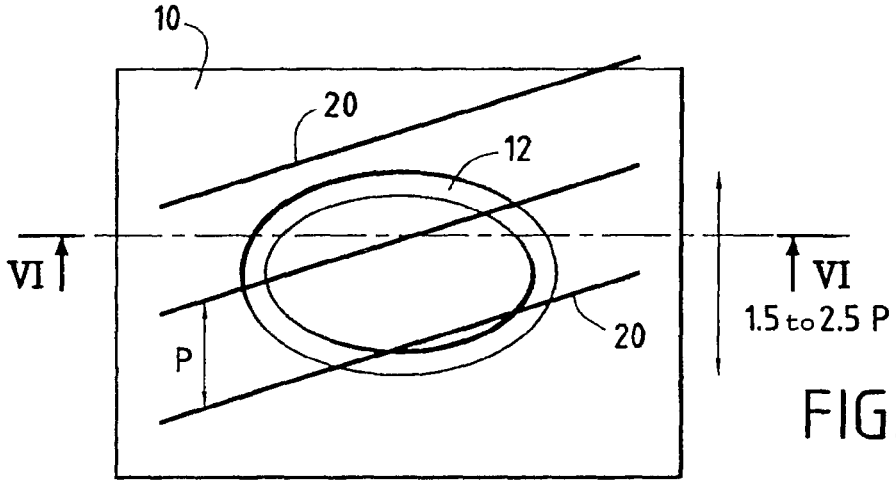
FIG. 5 is a fragmentary diagrammatic section in projection of the inside face facing towards the moving blade ends of a casing constituting a first variant of a second embodiment of the invention.
Figure 6:
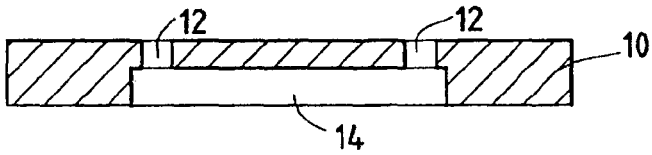
FIG. 6 is a fragmentary diagrammatic view in side section of the FIG. 5 casing seen along direction VI-VI.

In the first variant of the second embodiment as shown in FIGS. 5 and 6, there can be seen the casing 10 which in addition to having a groove 12 of closed outline and of oval shape analogous to that shown in FIG. 1, also includes a rear cavity 14 of annular shape facing the treatment zone of the casing over the entire periphery thereof. The grooves 12 open out into the cavity 14, thus providing communication between the various treatment zones that may be present on different angular sectors.

Figure 4:
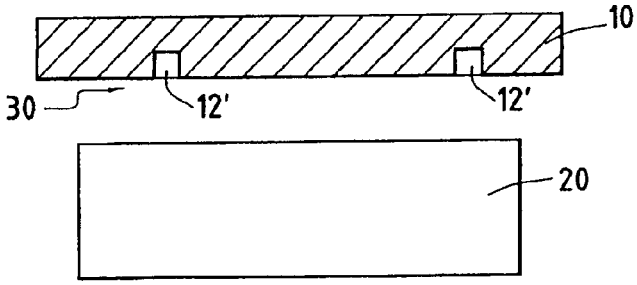
Figure 7:
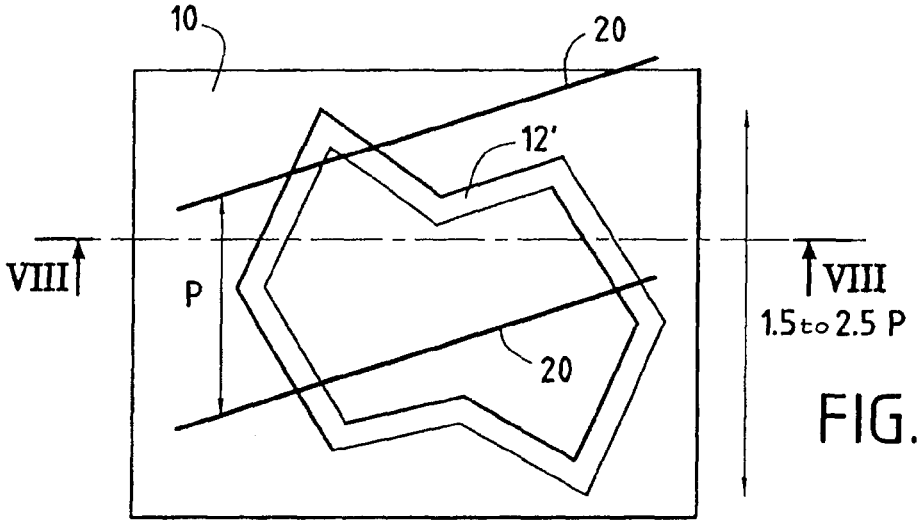
FIGS. 7 and 8 are views similar to FIGS. 5 and 6 for a second variant of the second embodiment of the invention.
Figure 8:
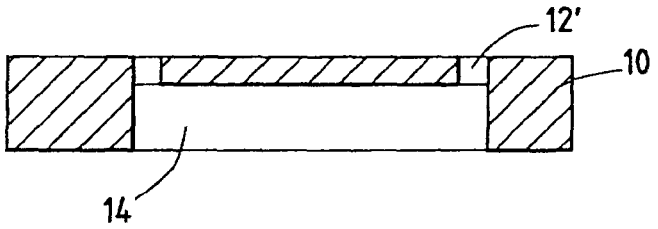

In FIGS. 7 and 8, there can be seen a second variant of the second embodiment, in which an annular rear cavity 14 is provided facing a treatment zone similar to that of the second variant of the first embodiment as shown in FIGS. 3 and 4, i.e. a groove 12' of closed outline and of irregular octagonal shape, opening out into the cavity 14.

In each of the variants of the second embodiment, the cavity 14 preferably presents a depth corresponding to one to three times the depth of the treatment zone (of the groove 12 or 12' of closed outline), and a width in the axial direction that is preferably greater than the width of the treatment zone, and in particular 10% to 20% greater (specifically the width of the treatment zone corresponds to the axial distance occupied by the groove 12 or 12' of closed outline).

The cavity 14 may be obtained by machining.

In addition, it should be observed that if this rear cavity as shown in FIGS. 6 and 8 appears to open out to the rear surface of the casing 10, it should be understood that these figures show fragmentary views of the wall of the casing 10, which wall also includes a complementary annular part (not shown) that closes the cavity 14 so as to enable air to flow in regulated manner in the location of the annular cavity 14. The central parts of the treatment zones are fixed to said complementary annular part.

In a preferred disposition the treatment zone extends axially over a distance representing at least ⅔ of the length of the moving blades 20 in the axial direction.

In another preferred disposition, the depth of the cavity 14 lies in the range 1 to 4 times the depth of the treatment zone.

What is claimed is:

1. A casing supporting a series of stationary vanes between which vanes there are located series of moving blades that are movable in rotation about a longitudinal axis, radially outer ends of said moving blades being close to an inside face of the casing, the casing comprising, in at least an annulus situated facing one of the series of moving blades:

at least one casing treatment zone facing the blades, wherein the treatment zone includes at least one groove defining a closed outline with an outer perimeter and an inner perimeter, the outer and inner perimeter are both continuous, and a shape of the outer perimeter and a shape of the inner perimeter are similar.

2. A casing according to claim 1, wherein said zone is localized over an angular sector corresponding to 1.5 to 2.5 times the pitch of the moving blades.

3. A casing according to claim 1, wherein said treatment zone extends axially over a distance representing at least ⅔ of the length of the moving blades in the axial direction.

4. A casing according to claim 1, wherein said treatment zone comprises a groove of which the closed outline is generally curved.

5. A casing according to claim 4, wherein said treatment zone comprises an oval groove.

6. A casing according to claim 1, wherein said treatment zone comprises a groove defined by a step of rectilinear segments interconnected to form an irregular geometrical figure.

7. A casing according to claim 6, wherein said geometrical figure has eight sides.

8. A casing according to claim 1, wherein said casing treatment zone is formed in a plate fitted to the casing.

9. A casing according to claim 8, wherein said plate is made of an abradable material.

10. A casing according to claim 1, further including a cavity formed radially outside the treatment zone.

11. A casing according to claim 10, including a plurality of treatment zones and wherein said cavity of each treatment zone is in communication with said cavity of another treatment zone.

12. A casing according to claim 10, wherein the depth of said cavity lies in the range 1 to 4 times the depth of the treatment zone.

13. A casing according to claim 10, wherein the extent in the axial direction of said cavity lies in the range 10% to 20% greater than the extent in the axial direction of the treatment zone.

14. An axial compressor comprising:

a casing; the casing supporting a series of stationary vanes between which vanes there are located series of moving blades that are movable in rotation about a longitudinal axis, radially outer ends of said moving blades being close to an inside face of the casing, the casing including, in at least an annulus situated facing one of the series of moving blades:

at least one casing treatment zone facing the blades, wherein the treatment zone includes at least one groove defining a closed outline with an outer perimeter and an inner perimeter, the outer and inner perimeter are both continuous, and a shape of the outer perimeter and a shape of the inner perimeter are similar.

15. A turbomachine comprising:

an axial compressor including a casing, the casing supporting a series of stationary vanes between which vanes there are located series of moving blades that are movable in rotation about a longitudinal axis, radially outer ends of said moving blades being close to an inside face of the casing, the casing including, in at least an annulus situated facing one of the series of moving blades:

at least one casing treatment zone facing the blades, wherein the treatment zone includes at least one groove defining a closed outline with an outer perimeter and an inner perimeter, the outer and inner perimeter are both continuous, and a shape of the outer perimeter and a shape of the inner perimeter are similar.

16. A casing according to claim 1, wherein a start point and an end point of the groove are coincident.

* * * * *